United States Patent [19]

DeLucia

[11] 4,353,048

[45] Oct. 5, 1982

[54] GAS-FILLED ENVELOPE ENCLOSED HIGH VOLTAGE RELAY

[76] Inventor: Victor E. DeLucia, 11846 Mississippi Ave., Los Angeles, Calif. 90025

[21] Appl. No.: 305,453

[22] Filed: Sep. 25, 1981

[51] Int. Cl.[3] ..... H01H 1/66

[52] U.S. Cl. ..... 335/151; 335/154

[58] Field of Search ..... 335/151, 154, 202, 153, 335/152, 201

[56] References Cited

U.S. PATENT DOCUMENTS 3,891,950 6/1975 DeLucia ..... 335/154 X 4,039,984 8/1977 DeLucia ..... 335/151

4,168,480 9/1979 DeLucia ..... 335/151

*Primary Examiner*—George Harris

[57] ABSTRACT

A high voltage relay is provided of the double-pole, double-throw type which is enclosed in a gas-filled envelope, and which has particular application to medical purposes, although it is not limited to such uses. The movable and fixed contacts of the relay are supported within the envelope, with the movable contact being supported for pivotal movement, and for selective engagement with the fixed contacts. The movable contacts are mounted on an insulating rod and, in accordance with the invention, the insulating rod is formed of glass filled epoxy resin.

2 Claims, 3 Drawing Figures

GAS-FILLED ENVELOPE ENCLOSED HIGH VOLTAGE RELAY

RELATED CASE

Application Ser. No. 136,257 filed in the name of the present inventor on Apr. 1, 1980, allowed May 8, 1981, and subsequently abandoned.

BACKGROUND

The relay of the invention may be used, for example, in defribrillator systems, in which double-throw, double-pole relays are used selectively to introduce a high voltage to the heart of the patient under precisely controlled conditions.

The relay is required to operate at high voltages, so that vacuum relays are well suited for the purpose because their contacts are enclosed within an evacuated envelope, and contact deterioration is materially reduced. However, ionization effects in vacuum relays has substantially limited their usefulness in that area.

The prior art relays of the type under consideration incorporate an envelope filled with a pressurized dielectric gas, such as sulfur hexafluoride ($SF_6$) to reduce the ionization within the envelope, and also to provide a cooling effect. Mixtures of sulfur hexafluoride with argon and nitrous oxide have also been used to provide an effective gaseous atmosphere within the relay to prevent ionization effects and to provide the desired cooling. Activated alumina may be introduced into the housing as a getter for the corrosive fluorine compounds, in order to prevent harmful effects should the sulfur hexafluoride break down.

Problems have been encountered in providing suitable insulating rods on which to mount the movable contacts in such prior art gas-filled relays. This is because the rods must exhibit high insulating characteristics, high strength, and yet be immune to corrosive attacks from the gas or gases within the envelope. The prior art relays exclusively have used sapphire rods since, prior to the present invention, sapphire rods were considered to be the only rods which fulfilled all the criteria. However, sapphire rods are extremely expensive, and are somewhat brittle.

In the relay of the present invention, the sapphire rod of the prior art is replaced with a rod formed of a glass filled epoxy resin. This latter rod is inexpensive, and yet it possesses all the strength and electrical insulating properties of the prior art sapphire rods. In addition, the glass filled epoxy rod exhibits a resiliency which is most advantageous in assuring that firm electrical contact between the movable and fixed contacts of the relay will be maintained over long operating periods and under changing ambient conditions.

In the practice of the invention, glass filled epoxy resin rods are purchased as a standard item, and are then centerless ground to the desired diameter, and cut to the desired length.

DETAILED DESCRIPTION OF THE ILLUSTRATED EMBODIMENT

Figure 2:
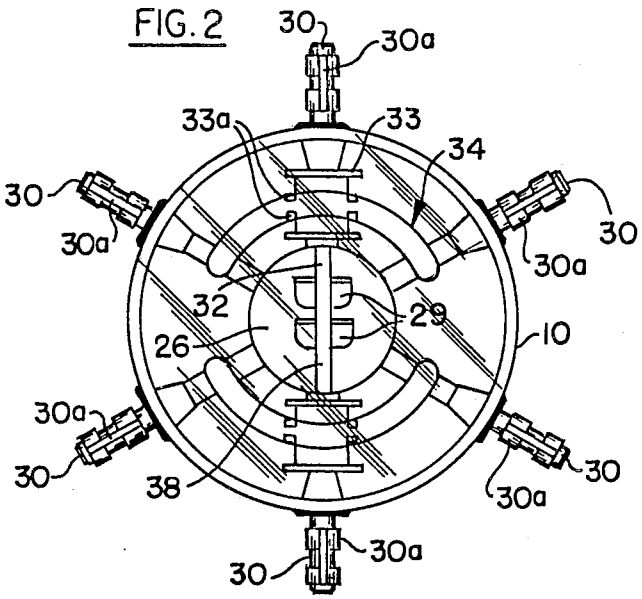
FIG. 2 is a section taken along the line 2—2 of FIG. 1.
Figure 3:
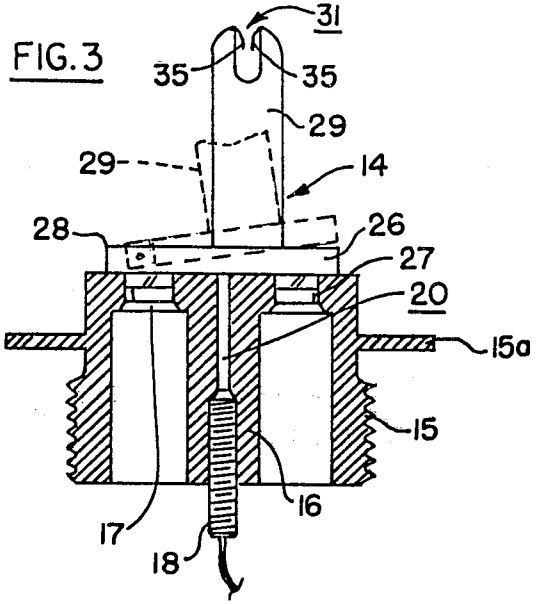
FIG. 3 is a side elevation, partly in section, showing certain operating components of the relay of FIG. 1.
Figure 1:
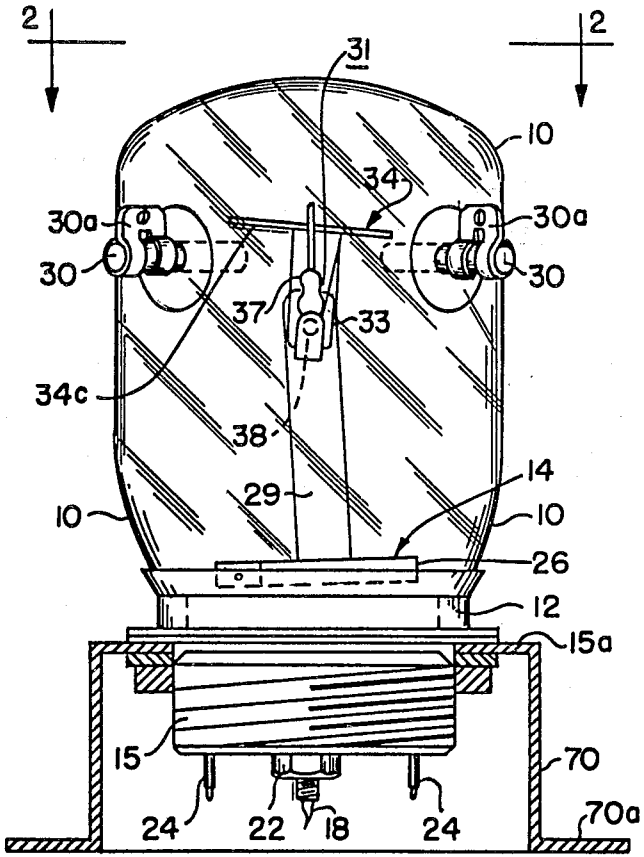
FIG. 1 is a side elevation, partly in section, of a double-pole, double-throw envelope enclosed relay which may be constructed in accordance with the invention.

The relay illustrated in FIGS. 1–3 includes, for example, an envelope 10 which may be formed of glass or other suitable vitreous material. Envelope 10 may have a generally cylindrical configuration with a closed top and an open bottom. A metal ring 12, formed of appropriate material such as Kovar, is sealed to the periphery of the open end of envelope 10, and the ring 12 includes an integral lower radially extending flange portion.

An armature assembly, designated generally as 14, is mounted on ring 12, and the armature assembly extends into envelope 10, as shown in FIG. 1. The envelope is filled with a suitable inert gas, as will be described. The top of the envelope has a bulb-like configuration for added strength so as to withstand the internal pressure of the inert gas. The armature assembly includes, for example, a cylindrical-shaped member 15 formed of appropriate magnetic material to form a housing. The housing includes a peripheral radially extending flange 15*a*. The housing is mounted on ring 12, as shown in FIG. 1, by welding the flange 15*a* to a flange portion of ring 12, or by otherwise affixing the two flanges to one another. The lower portion of the housing 15 is threaded, as shown in FIG. 3, for mounting purposes.

A central core member 16 (FIG. 3) formed of appropriate magnetic material is mounted coaxially within housing 15, and the core member is held in place by means of a washer 17 of non-magnetic material, the washer being welded to housing 15 and to central core 16. The energizing coil for the relay (not shown) is supported within housing 15 and extends around the central bore 16.

A tube 18 is threaded into the lower end of core 16, and the tube communicates with a passage 20 which extends through the core and into the interior of envelope 10. The sulfur hexafluoride, or other inert gas or gases, may be introduced into the interior of envelope 10 through tube 18 until a desired pressure is reached. The tube 18 is then pinched off and sealed, as shown in FIG. 1. The remaining part of tube 18 is securely held in core 16 by means of a nut 22, as shown in FIG. 1, the nut also serving to retain the energizing coil within housing 15. Appropriate terminals 24 are provided for the energizing coil within the cylindrical member so that the coil may be appropriately energized.

As mentioned above, the inert gas, or gases, are introduced into the interior of the envelope through passageway 20 which extends through the central pole of the magnetic core 16, and which includes an internally threaded lower end portion for receiving threaded tube 18, tube 18 and the central part of core 16 serving additionally not only as a passageway for the gas introduced into the envelope, but also as a support for nut 22.

The armature assembly 14 includes a magnetic armature 26 which is hinged to a member 28, and which extends across the upper end of core 16, and across the annular space between the core and the upper edge of housing 15. Member 28 is affixed to the upper end of housing 15, for example, by spot welding or other suitable means. A spring 27 (FIG. 3) is mounted in a recess formed in the upper end of housing 15, in a position to surround the upper end of core 16. Spring 27 bears against armature 26, and biases the armature in a clockwise direction in FIGS. 1 and 2. The armature assembly 14 includes a pair of upright support arms 29 which are welded, or otherwise affixed to armature 26, and which extend upwardly within envelope 10, as shown in FIGS. 1, 2 and 3.

The support arms 29 each have a slot 31 in its upper end, as shown in FIGS. 1 and 3. When the relay is de-energized, spring 27 causes armature 26 to be biased in a counterclockwise direction, as mentioned above, so that the support arms 29 normally have a tilted inclination, as shown in FIG. 1, and as shown by the broken lines in FIG. 3. Then, when the relay is energized, armature 26 is pulled down against the bias of spring 27, so that the support arms 29 assume the upright position shown by the solid line in FIG. 3.

The relay assembly includes four terminal pins which are designated 30 in FIG. 1, and which, as best shown in FIG. 2, extends through the envelope 10 in radial directions. The terminal pins 30 also serve as fixed contacts for the relay. A further pair of terminal pins 37 (FIGS. 1 and 2) extends through the wall of envelope 10 between the pins 30, as clearly shown in FIG. 2. Terminal pins 37, for example, constitute the movable contact terminals for the double-pole, double-throw relay. In one position of the relay, for example, pins 37 are respectively connected to the pins 30 to the left in FIG. 2; and in the second position of the relay, pins 37 are connected respectively to pins 30 to the right in FIG. 2.

The selected connection between pins 37 and pins 30 is achieved by means of a pair of arcuate movable contacts 34, the movable contacts being pivotally supported on the respective pins 37, and the movable contacts being interconnected by means of a rod 38. In the prior art, and as described above, the insulating rod is formed of sapphire. However, in accordance with the present invention, this rod is formed of a glass filled epoxy resin. As shown in FIG. 1, rod 38 is displaced down from the common axis of pins 37, and it extends into the slots 31 at the tops of support arms 29. Rod 38 is mechanically coupled to the arcuate contacts 34 by means of respective U-shaped clips 33. The clips are mounted on the arcuate contacts 34 by means, for example, of bent-over ears 33*a*.

The invention provides, therefore, a particular type of double-pole, double-throw relay in which the operating contacts are positioned within an envelope, the envelope being filled with a selected gas, or mixture of gases. As described above, and in accordance with the present invention, the movable contacts are insulated from one another by a rod which is particularly constructed to provide high insulating characteristics, high strength, and yet be impervious to corrosive attacks from the gas or gases. The rod also exhibits a degree of resiliency, which enhances the electrical operating characteristics of the relay. As described, the rod, unlike the rods used in the prior art relays is relatively inexpensive, and is formed of a glass-filled epoxy resin.

What is claimed is:

1. In a relay which includes an envelope having a generally tubular configuration, a first electrically conductive contact pin extending radially into the envelope, a first arcuately-shaped movable contact extending transversely to the axis of said first contact pin, electrically conductive means affixed to an intermediate part of said movable contact and pivotally mounted on said first contact pin to cause said movable contact to be electrically connected to said first contact pin, and a pair of further electrically conductive pins extending radially into said envelope on each side of said first pin to be selectively engaged by the ends of said movable contact as the movable contact is pivotally moved between a first and second angular position, and magnetic armature means mounted in said envelope and mechanically coupled to said movable contact to turn said movable contact selectively about the axis of said first contact pin between said first and second angular positions, a second electrically conductive contact pin extending radially into said envelope diametrically opposite said first pin and coaxially therewith, a second arcuate movable contact pivotally mounted on said second contact pin at an intermediate part of said arcuate movable contact, a second pair of further electrically conductive contact pins extending radially into said envelope on each side of said second pin to be engaged selectively by said second movable contact as it is turned between a first and a second angular position about the common axis of said first and second contact pins, said envelope being filled with a high pressure gas to prevent ionization between said contacts and to provide cooling therefor; an insulating rod formed of glass-filled epoxy resin interconnecting said first and second movable contacts, said rod extending parallel to said common axis but displaced therefrom, and said magnetic armature being mechanically coupled to said rod.

2. The relay defined in claim 1, and which includes a pair of support arms mounted in spaced relationship on said magnetic armature means and extending to spaced positions along said insulating rod to couple said magnetic armaure means mechanically to said insulating rod.

* * * * *